US010253540B2

(12) United States Patent
Bell et al.

(10) Patent No.: US 10,253,540 B2
(45) Date of Patent: Apr. 9, 2019

(54) APPARATUS FOR CONNECTING DOOR CLOSER OR OPERATOR TO SWING DOOR

(71) Applicant: Yale Security, Inc., Monroe, NC (US)

(72) Inventors: Robert Matthew Bell, Clarksville, TN (US); Peter Zasowski, Yantis, TX (US); Dustin Lawhon, Lilesville, NC (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 49 days.

(21) Appl. No.: 15/415,065

(22) Filed: Jan. 25, 2017

(65) Prior Publication Data

US 2017/0130500 A1 May 11, 2017

Related U.S. Application Data

(62) Division of application No. 14/902,163, filed as application No. PCT/US2014/054714 on Sep. 9, 2014, now Pat. No. 10,024,094.

(60) Provisional application No. 61/875,305, filed on Sep. 9, 2013.

(51) Int. Cl.
*E05F 3/22* (2006.01)
*E05F 15/63* (2015.01)

(52) U.S. Cl.
CPC ..... *E05F 3/227* (2013.01); *E05F 15/63* (2015.01); *E05Y 2201/624* (2013.01); *E05Y 2201/636* (2013.01); *E05Y 2201/706* (2013.01); *E05Y 2600/322* (2013.01); *E05Y 2600/324* (2013.01); *E05Y 2800/26* (2013.01);
(Continued)

(58) Field of Classification Search
CPC ... E05F 1/00; E05F 3/227; E05F 15/63; E05F 2015/631
See application file for complete search history.

(56) References Cited

U.S. PATENT DOCUMENTS 1,119,572 A 12/1914 Butler
2,712,739 A 7/1955 Dempster
(Continued)

FOREIGN PATENT DOCUMENTS

DE 29801862 U1 4/1998
GB 217525 A 6/1924

*Primary Examiner* — Catherine A Kelly
(74) *Attorney, Agent, or Firm* — DeLio, Peterson & Curcio, LLC; David R. Pegnataro

(57) ABSTRACT

A door closer, comprising a door closer housing mounted to one of a door frame or a door surface and a linkage arm for pivoting the door between open and closed positions. The linkage arm has a first and second end, the first end mounted to the other of the door frame or the door surface. The door closer includes a rotatable connector between the linkage arm and the door closer housing, the linkage arm second end engaging with the rotatable connector. The connector has a rotatable body portion and head protrusion substantially secured in a female receptor to transmit rotation about a longitudinal axis of the connector. One or both of the head protrusion or female receptor has a curved profile and is further movable with respect to the head protrusion to permit limited rotational misalignment of the linkage arm on any axis perpendicular to the connector longitudinal axis.

15 Claims, 7 Drawing Sheets

(52) U.S. Cl.
CPC ..... *E05Y 2800/40* (2013.01); *E05Y 2800/45* (2013.01); *E05Y 2900/132* (2013.01)

(56) References Cited

U.S. PATENT DOCUMENTS 2,942,291 A * 6/1960 Flint ..... E05C 17/32 16/49
2,960,718 A * 11/1960 Lasier ..... E05F 3/00 16/49
3,656,204 A * 4/1972 Brown ..... E05F 3/106 16/52
3,769,644 A * 11/1973 Case ..... B25F 1/00 254/26 R
4,102,005 A 7/1978 Schnarr
4,246,811 A 1/1981 Bondhus et al.
4,464,141 A * 8/1984 Brown ..... F16D 3/185 464/150
5,007,880 A * 4/1991 Walker ..... F16D 3/185 464/159
5,069,569 A 12/1991 Lieser
5,440,839 A 8/1995 Piltingsrud
5,497,533 A * 3/1996 Karlsen ..... E05F 3/00 16/49
5,527,220 A 6/1996 Geczy
6,412,224 B1 7/2002 Feucht
6,767,048 B2 * 7/2004 Yokota ..... E05F 15/619 296/146.4
7,377,075 B2 * 5/2008 Oberheide ..... B60J 5/101 296/56
7,971,316 B2 7/2011 Copeland, II
8,341,889 B2 * 1/2013 Faulkner ..... E05F 15/603 49/339
8,366,339 B2 * 2/2013 Lin ..... F16C 11/0604 403/57
8,415,902 B2 * 4/2013 Burris ..... E05F 3/102 16/52
8,490,330 B2 * 7/2013 Lund ..... E05C 17/30 292/1
8,527,101 B2 * 9/2013 Burris ..... E05F 3/102 16/71
8,845,006 B2 * 9/2014 Lechkun ..... B60J 5/106 296/106
9,234,378 B2 * 1/2016 Hansen ..... E05F 15/63
9,523,231 B2 * 12/2016 Ciavaglia ..... E05F 15/63
2004/0098915 A1 * 5/2004 Baldry ..... E05B 17/0029 49/339
2010/0071264 A1 * 3/2010 Faulkner ..... E05F 15/603 49/26
2011/0252597 A1 10/2011 Burris et al.
2012/0048669 A1 * 3/2012 Hong ..... F16H 31/001 192/21
2012/0144623 A1 6/2012 Woo
2013/0199321 A1 * 8/2013 Oberle ..... F16D 7/021 74/89.14
2014/0137477 A1 * 5/2014 Ooe ..... E05F 1/1091 49/358
2014/0165329 A1 * 6/2014 Wildforster ..... E05F 3/22 16/71
2015/0143666 A1 * 5/2015 Winkler ..... E05F 5/12 16/235
2015/0211278 A1 * 7/2015 Moyer ..... E05F 3/102 16/52
2015/0256048 A1 * 9/2015 Ohta ..... E05F 3/02 310/80
2016/0325817 A1 * 11/2016 Buttelmann ..... E05D 15/04
2017/0183903 A1 * 6/2017 Schwendemann ..... E05F 15/63

* cited by examiner

APPARATUS FOR CONNECTING DOOR CLOSER OR OPERATOR TO SWING DOOR

BACKGROUND OF THE INVENTION

1. Field of the Invention

The present invention is directed to connections between a door closer or operator and a closer arm for a door.

2. Description of Related Art

A door closer or operator includes a rotatable pinion shaft oriented in the vertical (Z) direction which is connected to one end of the arm that transmits the motion of the door. Current practice for connecting a door closer or operator arm is to lock all 6 degrees of freedom to the pinion shaft using a broached or milled square or hex hole in the arm with a shaft of the same shape and a locking screw for assembly. This results in several issues. The door closer or operator must be mounted (positioned) properly to minimize side loading of the bearings in the housing caused by misalignment of the arm due to the rigid connection of the arm to the door or arm knuckle. The connection causes unavoidable wear issues, loss in efficiency, decreased closing force, component fatigue/failure and prohibits the use of certain applications such as cam lift hinges. Additionally rigid attachment at the pinion and possibly at the door end of the arm creates the need for exact templating, alignment, manufacturing, and installation.

SUMMARY OF THE INVENTION

Bearing in mind the problems and deficiencies of the prior art, it is therefore an object of the present invention to provide a door closer connection between the door closer and linkage arm which allows rotational transmission of movement between the door closer pinion and the linkage arm and prevents binding between the door closer pinion and the linkage arm.

It is another object of the present invention to provide a door closer connection which reduces wear on the door closer and any linkage attached to the door closer.

A further object of the invention is to provide a door closer connection which transmits rotational movement of the attached components about the longitudinal axis Z and allows the components to move relative to each other in rotation about the X and Y axis.

It is yet another object of the present invention to provide a door closer connection which includes a polygonal barrel protrusion on one part of the connection and an aperture having the same number of sides as the barrel protrusion and engagable with the barrel protrusion.

Still other objects and advantages of the invention will in part be obvious and will in part be apparent from the specification.

The above and other objects, which will be apparent to those skilled in the art, are achieved in the present invention which is directed to a door closer, comprising a door closer housing mounted to one of a door frame or a door surface and a linkage arm for pivoting the door between open and closed positions, the linkage arm having a first and second end, the first end mounted to the other of the door frame or the door surface. The door closer includes a rotatable connector between the linkage arm and the door closer housing, the linkage arm second end engaging with the rotatable connector. The connector has a rotatable body portion in the door closer housing and a head protrusion substantially secured in a female receptor to transmit rotation about a longitudinal axis of the connector. One or both of the head protrusion or female receptor has a curved profile viewed along the longitudinal axis of the connector, the female receptor being further movable with respect to the head protrusion to permit limited rotational misalignment of the linkage arm on any axis perpendicular to the connector longitudinal axis.

The connector head protrusion may have a geometrically-shaped cross section and a generally barrel-shaped profile along the longitudinal axis of the connector and the female receptor may have substantially straight walls and closely conform in diameter to a midpoint of the connector head protrusion profile to enable the connector head protrusion to be slideably secured in the female receptor. The connector head protrusion may have a geometrically-shaped cross section and a generally barrel-shaped profile along the longitudinal axis of the connector and the female receptor has substantially smoothly-tapered conforming walls with the connector head protrusion profile. The connector head protrusion may have a geometrically-shaped cross section and a generally straight profile along the longitudinal axis of the connector and the female receptor may have a substantially hourglass-shaped cross-section and have a midpoint with a diameter closely conforming to a midpoint of the connector head protrusion profile to enable the connector head protrusion to be slideably secured in the female receptor.

In another aspect, the present invention is directed to a door closer, comprising a door closer housing mounted to one of a door frame or a door surface and a linkage arm for pivoting the door between open and closed positions, the linkage arm having a first and second end, the first end mounted to the other of the door frame or the door surface. The door closer includes a rotatable connector between the linkage arm and the door closer housing, the linkage arm second end engaging with the rotatable connector, the connector having a rotatable body portion in the door closer housing and a head protrusion substantially secured in a female receptor to transmit rotation about a longitudinal axis of the connector, the connector head protrusion having a geometrically-shaped cross section and a generally barrel-shaped profile along the longitudinal axis of the connector. The female receptor may be further movable with respect to the head protrusion to permit limited rotation of the linkage arm on any axis perpendicular to the connector longitudinal axis. The connector head protrusion may be integral with the connector body portion. The connector head protrusion may be separable from the connector body portion. The rotatable connector may be engaged with the linkage arm second end at a substantially 90° angle. The connector head protrusion may be removably secured in the female receptor and disengageable by a specified force applied along the connector body portion longitudinal axis. The female receptor may have a correspondingly-shaped cross-section to that of the connector head protrusion. The female receptor may have substantially straight walls and closely conform in diameter to a midpoint of the connector head protrusion profile to enable the connector head protrusion to be slideably secured in the female receptor. The female receptor may be disposed in the linkage arm second end. The connector head protrusion may be disposed on the linkage arm second end and the female receptor may be integral with the connector rotatable body portion. The connector head protrusion may include a threaded opening for securing the rotatable connector to the linkage arm second end with a fastener. The connector head protrusion may be substantially secured in the female receptor using at least one ball and at least one spring may be interposed between the female receptor and the connector head protrusion around the periphery of the connector head protrusion. The connector head protrusion may include at least one ball and at least one spring disposed around the periphery of the connector head protrusion substantially securing the connector head protrusion in the female receptor. The door closer housing may be mounted to a door surface, the door interposed in a door frame having a track for slideably receiving the linkage arm first end, the linkage arm first end slideably received in the track. The linkage arm may be comprised of a first segment and a second segment, the first and second segments forming a plane and pivotably joined at a midpoint of the linkage arm.

In another aspect, the present invention is directed to a door closer comprising a door closer housing mounted to one of a door frame or a door surface and a linkage arm for pivoting the door between open and closed positions, the linkage arm having a first and second end, the first end mounted to the other of the door frame or the door surface. The door closer includes a rotatable connector between the linkage arm and the door closer housing, the linkage arm second end engaging with the rotatable connector, the connector having a rotatable body portion in the door closer housing and a head protrusion substantially secured in a female receptor to transmit rotation about a longitudinal axis of the connector. The connector head protrusion has a geometrically-shaped cross section and a generally straight profile along the longitudinal axis of the connector and the female receptor has a substantially hourglass-shaped cross-section, the female receptor further having a midpoint with a diameter closely conforming to a midpoint of the connector head protrusion profile to enable the connector head protrusion to be slideably secured in the female receptor. The female receptor is further movable with respect to the head protrusion to permit limited rotation of the linkage arm on any axis perpendicular to the connector longitudinal axis.

In another aspect, the present invention is directed to a method of connecting a door closer to a swing door, comprising the steps of providing a door closer housing mounted to one of a door frame or a door surface and providing a linkage arm for pivoting the door between open and closed positions. The linkage arm has a first and second end, the first end mounted to the other of the door frame or the door surface. The method includes providing a rotatable connector between the linkage arm and the door closer housing, the linkage arm second end engaging with the rotatable connector, the connector having a rotatable body portion in the door closer housing and a head protrusion and providing a female receptor for receiving the connector head protrusion, one or both of the head protrusion or female receptor having a curved profile viewed along a longitudinal axis of the connector. The method includes substantially securing the connector head protrusion in the female receptor to transmit rotation about the longitudinal axis of the connector, the female receptor being further movable with respect to the head protrusion to permit limited rotational misalignment of the linkage arm on any axis perpendicular to the connector longitudinal axis.

In another aspect, the present invention is directed to a method of using a swing door, comprising the steps of providing a door in an open or closed position interposed in a door frame and secured to the door frame by at least one hinge and providing a door closer housing mounted to one of the door frame or the door surface. The method includes providing a linkage arm for pivoting the door between open and closed positions, the linkage arm having a first and second end, the first end mounted to the other of the door frame or the door surface. The method includes providing a rotatable connector between the linkage arm and the door closer housing, the linkage arm second end engaging with the rotatable connector. The connector includes a rotatable body portion in the door closer housing and a head protrusion substantially secured in a female receptor to transmit rotation about a longitudinal axis of the connector. One or both of the head protrusion or female receptor has a curved profile viewed along the longitudinal axis of the connector. The female receptor is further movable with respect to the head protrusion to permit limited rotational misalignment of the linkage arm on any axis perpendicular to the connector longitudinal axis. The method includes urging the door into the other of the open or closed position and rotating the connector about the longitudinal axis of the connector to move the linking arm. The method includes permitting limited rotational misalignment of the linkage arm on any axis perpendicular to the connector longitudinal axis during rotation of the connector. If the door is unpowered, urging the door into the other of the open or closed position causes the connector to rotate about the longitudinal axis of the connector. If the door is powered, rotating the connector about the longitudinal axis of the connector moves the linking arm and urges the door to open.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-26 of the drawings in which like numerals refer to like features of the invention.

Figure 1:
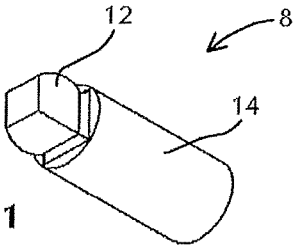
FIG. 1 is a perspective view of one embodiment of the door closer connector according to the present invention.
Figure 2:
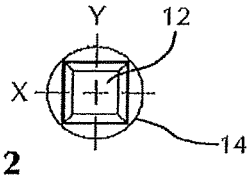
FIG. 2 is a top plan view of the connector shown in FIG. 1.
Figure 3:
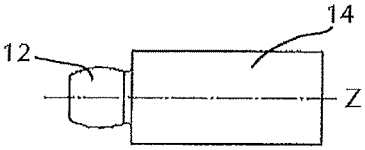
FIG. 3 is a side elevational view of the connector shown in FIG. 1.
Figure 4:
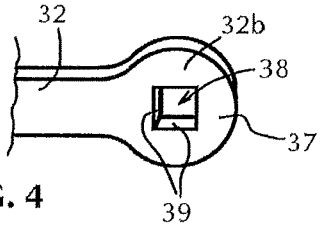
FIG. 4 is a top perspective view of an embodiment of the linkage arm end according to the present invention.

The present invention provides an improvement to the connection between a door closer or operator and the arm that transmits motion to and from a swing door as the door pivots between open and closed positions. (Unless otherwise indicated, the terms door operator herein includes door closer, and vice versa.) FIGS. 1-3 show a barrel connector for connecting a door closer to a swing door. The barrel connector 8 includes a head or protrusion 12 and a cylindrical body 14. Connector head 12 may have sides with a curved profile, in this case a generally barrel-shaped profile, when viewed along the longitudinal Z axis (FIG. 3), with the mid portion of the head tapering smoothly to narrower diameter or width at top and bottom portions of the head. Connector 8 is normally mounted so that its longitudinal Z axis is vertically oriented in the door closer housing (discussed below), and the connector rotates about the Z axis. The head 12 is engagable with a connector aperture 38, shown in FIG. 4, disposed on a linkage arm 32 at end 32*b* connecting the door closer 20 to a door 50. There are a plurality of sides on the head 12, four as seen in the view in FIG. 2 normal to the Z axis, which correspond with the number of sides (four) in the connector aperture 38. The walls 39 of the sides within connector aperture 38 may be straight along the Z axis, or may have a curved profile to conform to some degree to the barrel shape of the head, as long as the head can be fit into and removed from the aperture in the Z direction. The wider mid portion of the male connector head is sized to have a close sliding fit with the side walls in the female receptor or connector aperture 38.

Connector head 12 has a geometrically-shaped cross section when viewed in a cross section normal to the Z direction as shown in FIG. 2, i.e., it has multiple sides, edges or splines extending in the Z direction so that there is substantially no slippage between it and the corresponding geometrically-shaped cross section of the connector aperture as they rotate about the Z axis. Connector head 12 may be integrally formed with body 14, i.e., rigidly secured to or formed from one piece as shown in FIGS. 1-3, or it may be separable from the body, as will be discussed further below.

Figure 5:
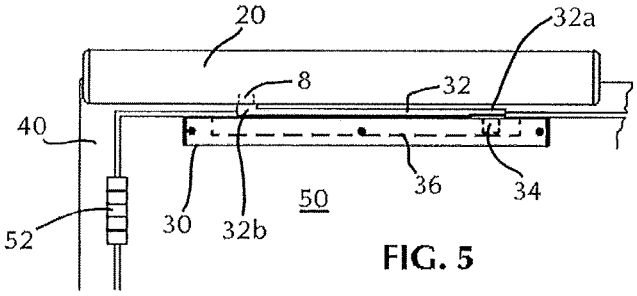
FIG. 5 is a front elevational view of a single arm door closer and door closer track according to an embodiment of the present invention.
Figure 6:
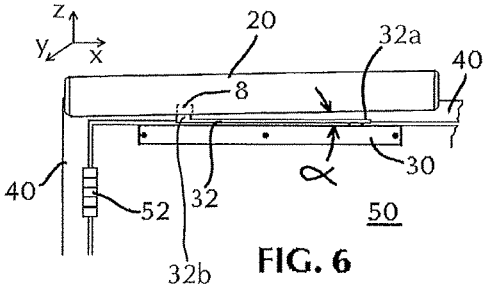
FIG. 6 is a front elevational view of the single arm door closer of FIG. 5 with the door closer installed at an angle to the door frame and door closer track.
Figure 7:
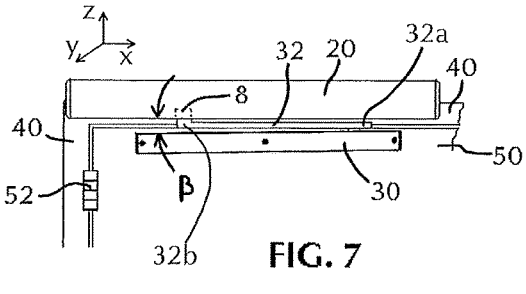
FIG. 7 is a front elevational view of the single arm door closer of FIG. 5 with the door closer track installed at an angle to the door frame and door closer.

FIG. 5 shows a door closer 20 attached to a door frame 40 with one end of a linkage arm 32 connected to a pinion on the door closer and the opposite end of the linkage arm 32 connected to a track 30 on the door 50. The barrel-shaped head of connector 8 and the connector aperture in linkage arm end 32*b* are rotationally locked with respect to one another by their close fit and corresponding geometrically-shaped cross sections so that rotation of the barrel connector 8 corresponds with rotation of the linkage arm 32. However, because connector head 12 is barrel-shaped, linkage arm 32 does not have to be installed horizontally at a perfect 90 degree angle to the vertical Z axis of the connector as in FIG. 5, and respective angular movement of the linkage arm 32 from the perpendicular direction of the X-Y plane during rotation about the Z axis is allowed to some degree. In other words, the male barrel-shaped head in the female receptor at the end of the linkage arm permits limited rotational misalignment of the linkage arm on or about any axis perpendicular to the connector longitudinal axis. In a door closer which has not been installed perfectly horizontally, such as in FIG. 6 wherein the door closer has been installed at an angle (alpha) to the horizontal door frame, door and track, the barrel connector and connector aperture prevent wear due to improper installation. Presenting a similar problem, FIG. 7 shows the track 30 not installed perfectly horizontally, but instead at an angle (beta) to the horizontal door frame, door 50 and closer 20. In both FIGS. 6 and 7, the limited rotational misalignment is about the Y axis. Again, because of its configuration, the normal rotation of the barrel connector and linkage arm about the Z axis does not place undue wear on the door closer connection since the barrel connector and linkage arm allow some angular movement outside of the plane of the X and Y directions. The installations in FIGS. 5, 6 and 7 show the door closer mounted on the door frame which includes one linkage arm attached between the door 50 and door closer, and the track 30 mounted on the door 50. Alternatively, the door closer 20 may be attached to the door with the track 30 attached to the door frame, as shown below in FIGS. 20 and 21.

Figure 8:
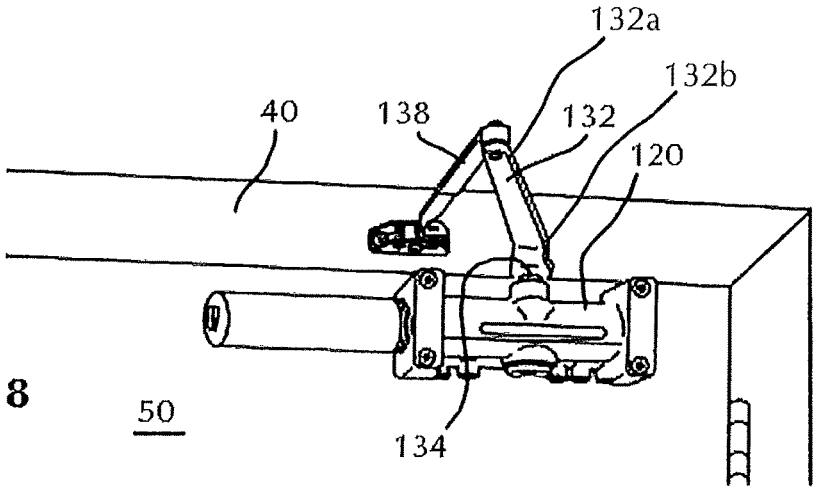
FIG. 8 is a front perspective view of an embodiment of a double arm door closer mounted on the pull side of a door.
Figure 9:
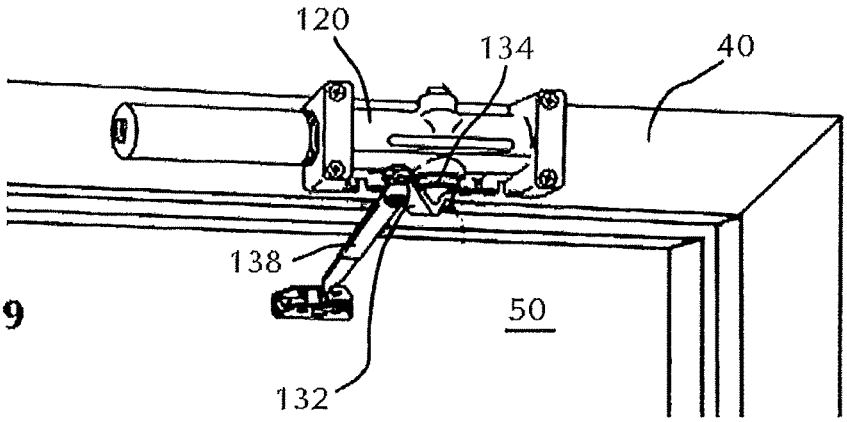
FIG. 9 is a front perspective view of an embodiment of a double arm door closer mounted on the door frame on the push side of a door.
Figure 10:
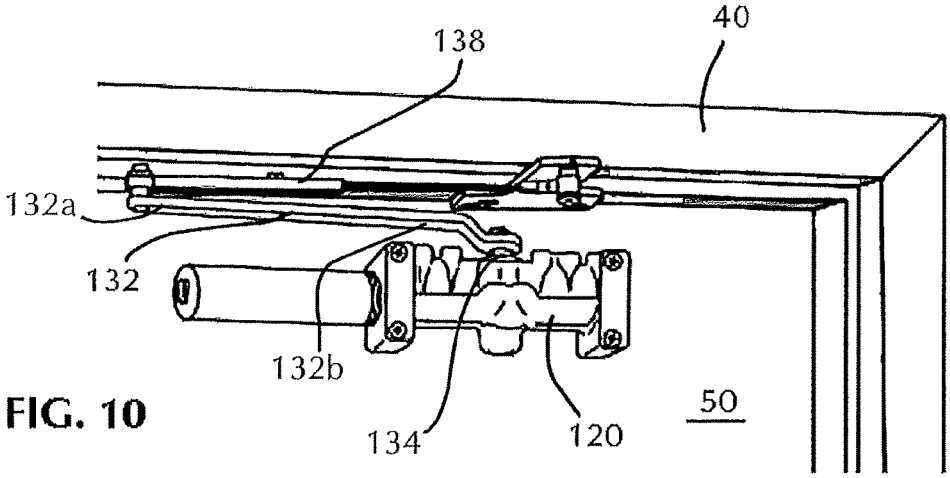
FIG. 10 is a front perspective view of an embodiment of a double arm door closer mounted on the push side of a door.

Instead of having one linkage arm with sliding track configuration, FIGS. 8-10 show another embodiment of a door closer 120 which may be used in door closing systems which include a first linkage arm 132 and a second linkage arm 138 connected in series from the door closer body 120 attached to the door 50 to the frame 40 (FIGS. 8 and 10) or from the door closer 120 connected to the frame to the door 50 (FIG. 9). In FIG. 8, the door closer is secured to the pull side of the door, and in FIG. 10 the door closer is secured to the opposite push side of the door. As before, the door closer 120 includes rotatable connector 134 having a barrel-shaped connector head securable to a connector aperture on the end 132*b* of first linkage arm 132.

In the embodiment of the door closer as shown in FIGS. 5-7, the door closer includes a door closer housing 20 mounted to a door frame or a door surface. A linkage arm 32 for applying a pivotal force on the door surface 50 includes a first end 32*a* and a second end 32*b*. The first end 32*a* of the linkage arm 32 may be mounted to a track 30 attached to the door frame 40 when the door closer is connected to the door surface 50 and alternatively to a track 30 attached to the door surface 50 when the door closer is connected to the door frame 40. The door closer may be a double arm closer as shown in FIGS. 8-10, the first end 132*a* of the linkage arm 132 may transmit a force to the door frame 40 when the door closer is connected to the door 50 and to the door surface 50 when the door closer is connected to the door frame 40. A second arm 138 may be connected to the door surface 50 or door frame 40 between the first end 132*a* of the linkage arm 132 and the door surface 50 or door frame 40. The second end 132*b* of the linkage arm 132 engages with a rotatable connector 134 between the second end 132*b* of the linkage arm 132 and the door closer housing 120.

Figure 11:
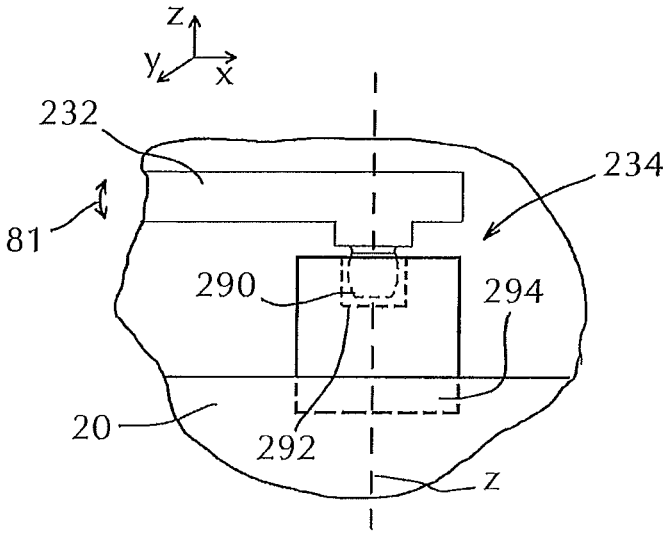
FIG. 11 is a side elevational view of another embodiment of the door closer connector according to the present invention.

As an alternative to the integral formation of the head 12 with the body 14 of connector 8 in FIGS. 1-3, the connector 234 as shown in FIG. 11 may have a rotatable body portion 294 in the door closer housing and a separate barrel-shaped head protrusion 290 at the end of linkage arm 232 substantially secured in a female receptor or connector aperture 292 formed within the end of body 294 to transmit rotation about a longitudinal Z axis of the connector 234. The connector head protrusion 290, as with head 12 of FIGS. 1-3, has a geometrically-shaped cross section normal to the longitudinal Z axis and a generally barrel-shaped profile along the longitudinal Z axis of the connector 234. The female receptor 292 is also movable with respect to the head protrusion 290 to permit limited rotation of the linkage arm 232 on any axis perpendicular to the connector longitudinal axis 100, in this case around the Y axis as shown by arrow 81. If the linkage arm 232 does rotate out of a position perpendicular to the Z axis of connector body 294, then the longitudinal axis of the connector head 290 will be out of axial alignment with the longitudinal axis of the connector body 294, and be at an angle thereto.

Figure 12:
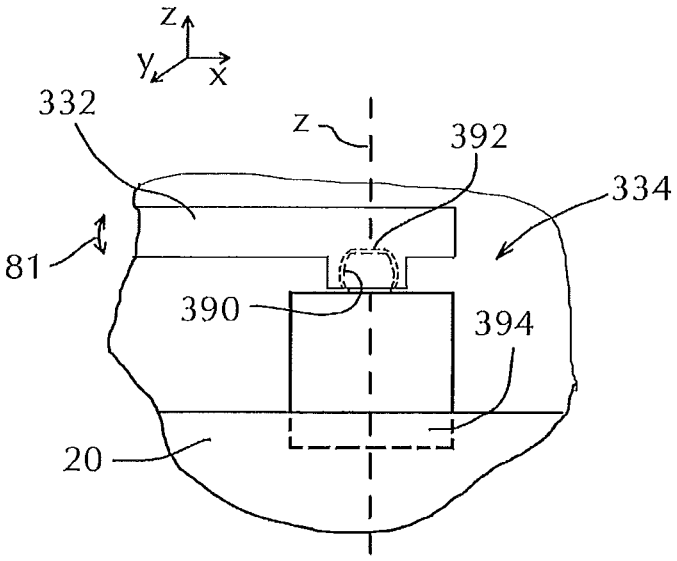
FIG. 12 is a side elevational view of another embodiment of the door closer connector according to the present invention.

The connector 234 as shown in FIG. 12 shows a configuration similar to that of FIGS. 1-3, with rotatable body portion 394 in the door closer housing and a barrel-shaped head protrusion 390 substantially secured in a female receptor 392 at the end of linkage arm 332 to transmit rotation about a longitudinal Z axis of the connector 334. Rather than being integrally formed with body 394, head 390 is removable and separable from body 394 by connection with a removable fastener (not shown). The connector head 390 may have a geometrically-shaped cross section and a generally barrel-shaped profile along the longitudinal Z axis of the connector 334 and the female receptor 392 may have substantially smoothly-tapered conforming walls with said connector head protrusion profile. The female receptor 392 is again movable with respect to the head protrusion 390 to permit limited rotation 81 of the linkage arm 332 on the Y axis or any axis perpendicular to the connector longitudinal Z axis.

Figure 13:
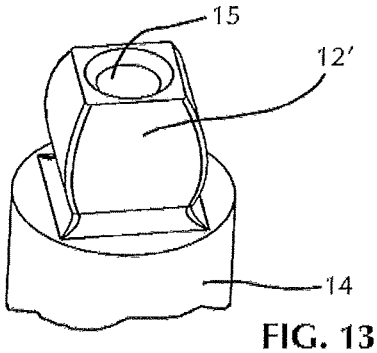
FIG. 13 is a perspective view of one embodiment of the door closer connector barrel according to the present invention.
Figure 14:
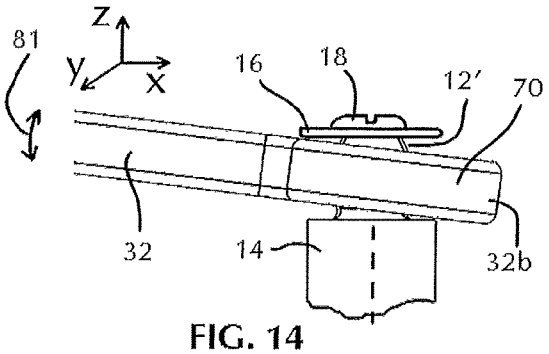
FIG. 14 is a side elevational view of the linkage arm end engaged with an embodiment of the door closer connector with the arm not perpendicular to the closer body or pinion in one direction.
Figure 15:
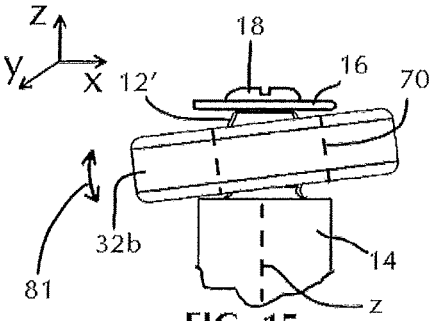
FIG. 15 is a front elevational view of the linkage arm end engaged with an embodiment of the door closer connector according to the present invention the arm not perpendicular to the closer body or pinion in another direction.
Figure 16:
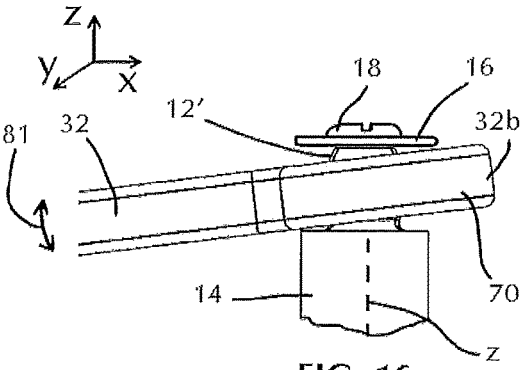
FIG. 16 is a side elevational view of the linkage arm end engaged with an embodiment of the door closer connector with the arm not perpendicular to the closer body or pinion in the opposite direction of the arm shown in FIG. 14.

FIG. 13 shows an embodiment of the barrel connector head 12' which has a geometrically shaped cross section of four sides and four edges, each side having a barrel-shaped profile along the Z axis. The connector head 12' may be removably engagable into and out of a connector aperture 70 shown in the end 32*b* of the linkage arm 32 in FIGS. 14-16. Translation along the Z axis is limited by a washer 16 on the upper end of the head and the cylinder body 14 on the lower end of the head 12'. The washer may be secured at the top of the head 12' by a screw 18 or other fastener extending into a head opening 15. The connector head 12' may include a threaded opening 15 which allows a screw 18 and washer 16 to secure the arm onto the connector head 12'. The body of the connector 14 prevents the arm from moving downward and the washer 16 prevents the arm from moving upward. FIGS. 14-16 show the permitted limited motion of linkage arm 32 at different angles up and down with respect to the X-Y plane, i.e., any axis perpendicular the Z-axis of connector body 14. In the case of FIGS. 14 and 16, the limited rotational misalignment 81 is about the Y axis, while in the case of FIG. 15 the limited rotational misalignment 81 is about the X axis.

Figure 17:
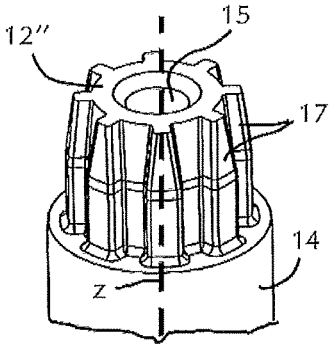
FIG. 17 is a perspective view of another embodiment of the door closer connector barrel according to the present invention.
Figure 18:
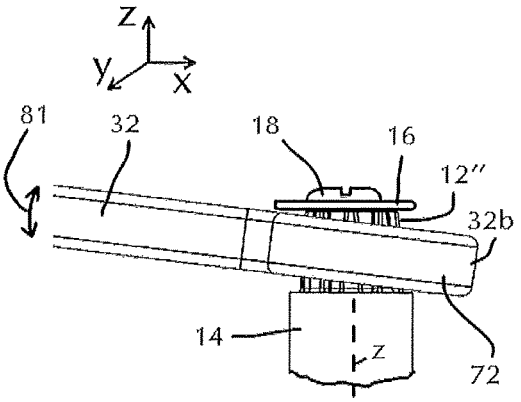
FIG. 18 is a side elevational view of the linkage arm end engaged with the door closer connector of FIG. 17 with the arm not perpendicular to the closer pinion.
Figure 19:
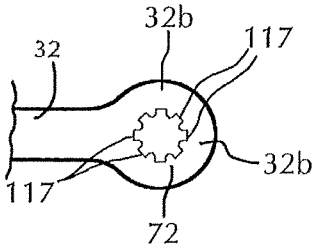
FIG. 19 is a top elevational view of the linkage arm end shown in FIG. 18.

FIGS. 17-19 show another embodiment of the barrel connector head 12" and linkage arm 72. The barrel-shaped connector head 12" has a geometrically shaped cross section that includes a plurality of splines 17 extending along the Z-axis which are engagable with corresponding slots 117 in the connector aperture 72 at the end 32*b* of the linkage arm 32. The number of sides (or splines, as shown in FIGS. 17-19) will determine the mounting options when attaching the linkage arm to the connector head. For example, an eight sided head would allow the linkage arm to be mounted at 45° intervals.

In the embodiment of connector head 12", the barrel shape is achieved by having the diameter of the head and splines taper to a narrower width only at the top of the head from the wider mid and lower portions. The barrel-shaped splines of head 12" permit limited rotational misalignment 81 about the Y axis (FIG. 18) or any axis perpendicular to the Z axis.

Figure 20:
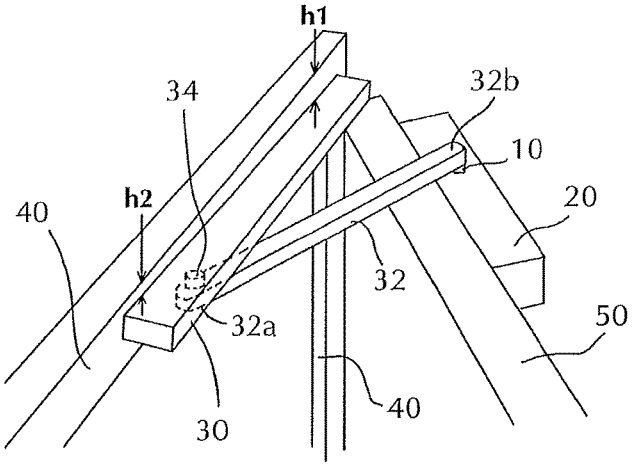
FIG. 20 is a perspective view of an embodiment of the door closer disposed on a door in the partially closed position.
Figure 21:
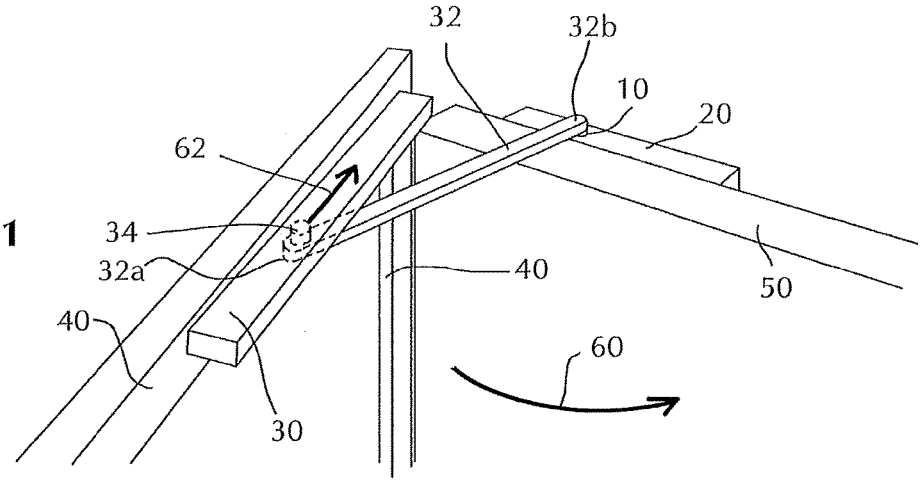
FIG. 21 is a perspective view of the door closer of FIG. 20 showing the forces on the linkage arm and connector when the door is pushed open.

FIGS. 20 and 21 show a door closer with the resulting force vectors when a force is applied to the door and the door pivots in direction 60 about the hinged side of the door. FIG. 20 starts with the door in a closed or partially closed position. The door 50 has an attached door closer 50 and connector 10, the connector 10 being any of the embodiments described above. The connector 10 is attached to the linkage arm 32 at the second end 32*b* of the linkage arm 32. The first end 32*a* of the linkage arm 32 may be slidingly connected to a track 30 on the door frame 40 with a roller or slide 34. The track 30 is shown installed askew in relation to the door 50, door frame 40 and door closer 20. As the door 50 is opened, the roller 34 moves from an end of the track which is a distance h2 from the top of the frame 40 to the opposite end of the track 30 where the track is a distance h1 from the top of the door frame 40. As the first end 32*a* of the linkage arm 32 moves in direction 62, the skewed track 30 forces the first end 32*a* in a downward direction. The movement in the downward direction is compensated for by the connector 10, preventing excess wear on the door closer 20, linkage arm 32, track 30 and door 50. If the door 50 is unpowered, opening the door causes the linking arm 32 to move and rotate, and cause connector 10 to rotate about the connector axis. If the door 50 is powered, rotating the connector 10 about its axis rotates linking arm 32 and causes the door 50 to open or close.

Figure 22:
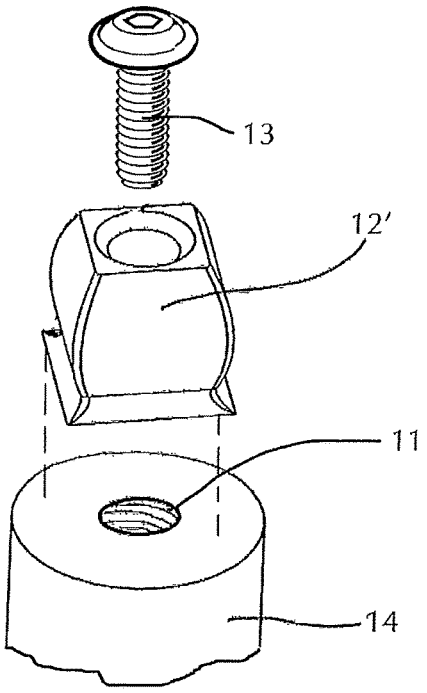
FIG. 22 is a perspective view of an embodiment of the door closer connector having the barrel portion and body portion removably attached to one another.
Figure 23:
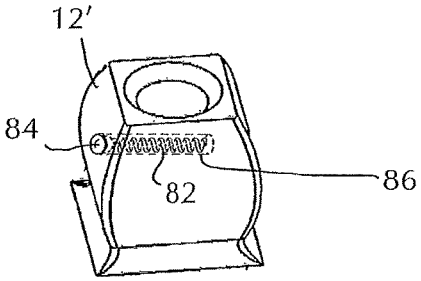
FIG. 23 is a perspective view of an embodiment of a barrel connector having a ball and spring for securing the barrel connector to the aperture of the linkage arm.
Figure 24:
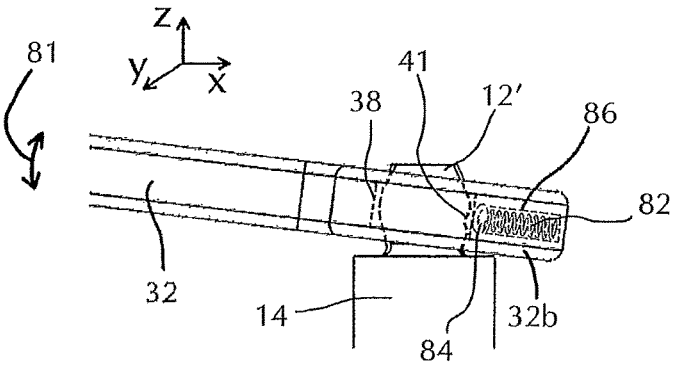
FIG. 24 is a perspective view of an embodiment of the linkage arm having a ball and spring adjacent the aperture for securing a barrel connector within the aperture.

The connector shown in FIG. 22 includes the head 12' separable from the cylinder body, such as with a threaded fastener 13 extending through the head and into threaded opening 11 at the end of the cylindrical body 14. Instead of or in addition to the washer maintaining the connector head in the female receptor at the end of the linkage arm, the connector head 12' shown in FIG. 23 includes a spring 82 and ball 84 disposed inside a cylindrical hole 86 in the head for urging the ball outward into and securing the head 12' within the female receptor 38. Alternately, the ball 84 and spring 82 may be disposed in opening 86 in the female receptor 38, as shown in FIG. 24, for securing the end 32*b* of the linkage arm onto the head 12'. The head 12' or female receptor 38 may have a detent 41 for engaging the ball 84. The spring 82 and ball 84 secure the connector head 12' inside the female receptor 38 and allow separation of the head 12' and female receptor 38 when a specified force is applied along the connector body portion longitudinal axis. The specified force may be determined by the spring coefficient and depth of the ball 84 within the detent 41.

The present invention may be used with any, door closer or operator that employs a double lever or slide track arm connected to a driven or driving shaft. The present invention provides in the door closer a driven or driving shaft with a head portion with a geometrically shaped cross section, e.g., having a square, hex, or other polygonal shape, or multi tooth spline, as seen in a cross section normal to the longitudinal axis of the connector head and/or body, along with a barrel-shaped profile along the longitudinal Z axis. The mating bar link may have an aperture or hole of matching geometry and a means for maintaining the interface and capturing the link on the shaft, such as but not limited to the aforementioned washer or spring-and-ball arrangements.

Figure 25:
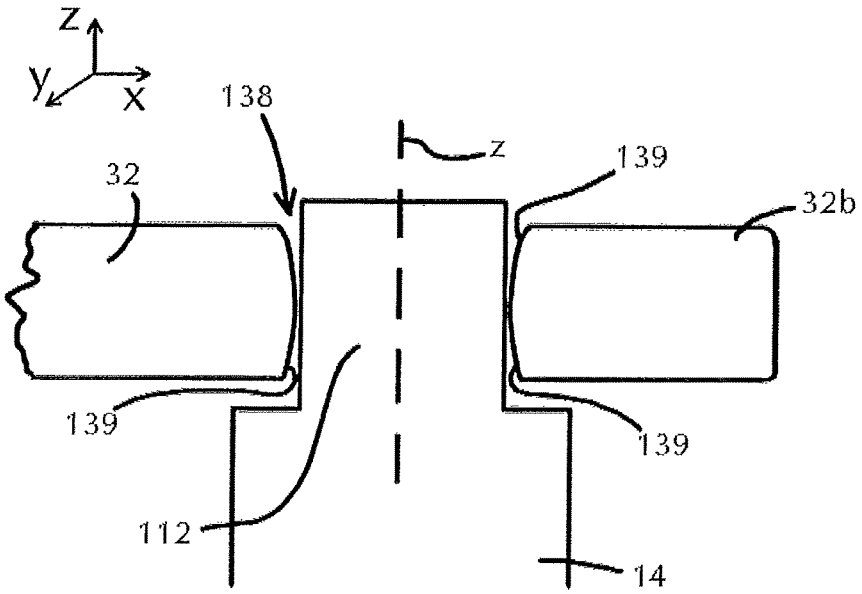
FIG. 25 is a side elevational view of an embodiment of the door closer connector of the present invention, wherein the connector head is straight and the walls of the connector female receptor or aperture are hourglass-shaped.
Figure 26:
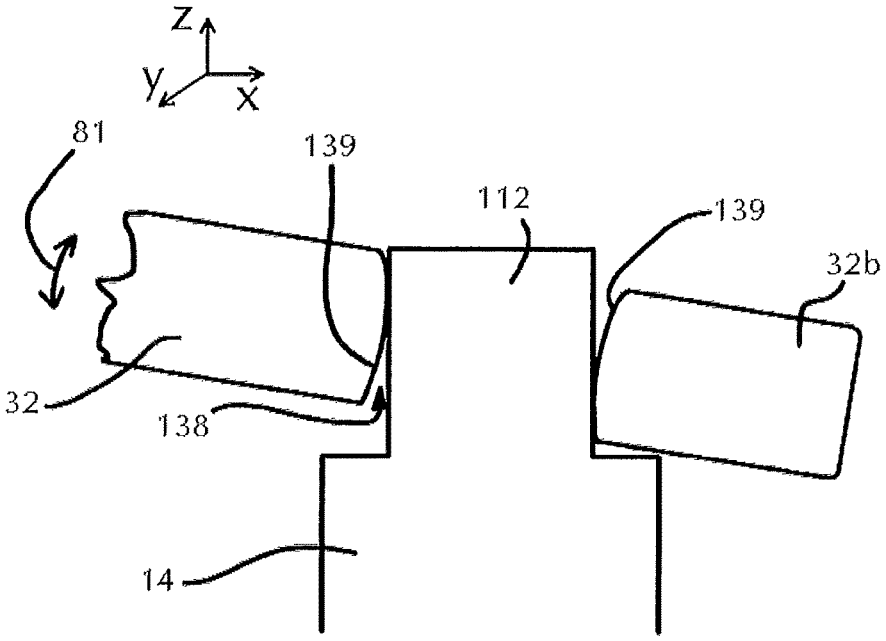
FIG. 26 is a side elevational view of the linkage arm end engaged with the door closer connector of FIG. 25 with the arm not perpendicular to the closer body or pinion in one direction.

While the walls of the female connector receptor or aperture have been described as being vertically straight or conforming to the barrel-shaped configuration of the head, the female receptor or aperture walls could also be hourglass-shaped, when seen in a cross section along the connector longitudinal axis, and used with a straight head or shaft of square, hex, or spline cross-section. An example of this alternative configuration is shown in FIGS. 25 and 26, where the connector head 112 still has a geometrically-shaped cross section when viewed in a cross section normal to the Z direction, but the sides of the head are vertical and straight. The interior sides of the female receptor have a curved profile when viewed along the longitudinal Z axis. In this embodiment, the walls 139 of the female receptor or aperture 138 at linkage arm end 32*b* are hourglass-shaped, with the mid portion as seen in the longitudinal cross section closely conforming in size and shape to have a close sliding fit with head 112, while portions of walls 139 and the top and bottom of the aperture 138 taper smoothly to a wider diameter or width. As seen in FIG. 26, the hourglass-shaped walls of the female aperture permit limited rotational misalignment of the connector aperture and linkage arm 32 in direction 81 about the Y axis or any axis perpendicular to the connector and head longitudinal Z axis.

In operation of the door closer or operator on a swing door, the door is secured to the door frame by one or more hinges and is initially in an open or closed position. The door closer or operator includes the connector body and head, linkage arm(s) and female receptor or aperture in any of the embodiments described above, wherein one or both of the sides of the head and/or female receptor have a curved profile when viewed along the longitudinal axis of the connector. The door is urged into the other of the open or closed position and the connector rotates about the longitudinal axis of the connector to move the linking arm(s). While this is occurring, the aforementioned designs of the head and connector female receptor or aperture allow some limited rotation, misalignment or wobble on any axis perpendicular to the connector pinion shaft, but ensures that they be rigid rotationally about the axis of the connector pinion shaft. This would eliminate undesirable loading by torque or misalignment due to normal field installation constraints (i.e., accuracy of the measurements, accuracy of the mounting hole location, and the like) or manufacturing tolerance. Using the connection according to the present invention would increase the longevity of the bearings, ease installation, decrease friction losses and decrease the likelihood of damage. The present invention may be incorporated in arm geometry for use with any closer or operator that uses either a track and arm or double lever arm configuration.

The object of the present invention has been achieved by providing a door closer connection between the door closer and linkage arm which allows rotational transmission of movement between the door closer pinion and the linkage arm and prevents binding between the door closer pinion and the linkage arm. The door closer connection reduces wear on the door closer and any linkage attached to the door closer. The door closer connection transmits rotational movement of the attached components about the longitudinal rotation axis and allows the components to move relative to each other at angles to the plane of the X and Y axis. The door closer connection includes a polygonal barrel protrusion on one part of the connection and an aperture having the same number of sides as the barrel protrusion engagable with the barrel protrusion. In any event, the configurations of the connector head and connector female receptacle or aperture as provided by the present invention are able to transmit rotation between them about the longitudinal axis of the connector head, while permitting limited rotation of the connector female receptacle or aperture and linkage arm on and about any axis perpendicular to the connector and head longitudinal axis.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door closer, comprising:

a door closer housing mounted to one of a door frame or a door surface;

a linkage arm for pivoting the door between open and closed positions, the linkage arm having a first and second end, the first end mounted to the other of the door frame or the door surface; and a rotatable connector between the linkage arm and the door closer housing, the linkage arm second end engaging with the rotatable connector, the connector having a rotatable body portion in the door closer housing and a head protrusion substantially secured in a female receptor to transmit rotation about a longitudinal axis of the connector to the linkage arm, the head protrusion having a curved profile viewed along the longitudinal axis of the connector and the female receptor having substantially straight walls, the female receptor closely conforming in diameter to a diameter of the connector head protrusion profile at a midpoint of the longitudinal axis to enable the connector head protrusion to be slideably secured therein such that the connector head protrusion and female receptor are rotationally locked about the longitudinal axis of the connector, the female receptor being further movable with respect to the head protrusion to permit limited rotational misalignment of the linkage arm on any axis perpendicular to the connector longitudinal axis as the door pivots between open and closed positions.

2. The door closer of claim 1 wherein the connector head protrusion has a geometrically-shaped cross section and a generally barrel-shaped profile along the longitudinal axis of the connector.

3. The door closer of claim 1, wherein the connector head protrusion has a geometrically-shaped cross section and a generally barrel-shaped profile along the longitudinal axis of the connector, the female receptor being further movable with respect to the head protrusion to permit limited rotation of the linkage arm on any axis perpendicular to the connector longitudinal axis.

4. The door closer of claim 1 wherein the connector head proprotrusion is integral with the connector body portion.

5. The door closer of claim 1 wherein the connector head protrusion is separable from the connector body portion.

6. The door closer of claim 1 wherein the rotatable connector is engaged with the linkage arm second end at a substantially 90° angle.

7. The door closer of claim 1 wherein the connector head protrusion is removably secured in the female receptor and disengageable by a specified force applied along the connector body portion longitudinal axis.

8. The door closer of claim 1 wherein the female receptor is disposed in the linkage arm second end.

9. The door closer of claim 1 wherein the connector head protrusion is disposed on the linkage arm second end and the female receptor is integral with the connector rotatable body portion.

10. The door closer of claim 9 wherein the connector head protrusion includes a threaded opening for securing the rotatable connector to the linkage arm second end with a fastener.

11. The door closer of claim 1 wherein the connector head protrusion is substantially secured in the female receptor using at least one ball and at least one spring interposed between the female receptor and the connector head protrusion around the periphery of the connector head protrusion.

12. The door closer of claim 1 wherein the connector head protrusion includes at least one ball and at least one spring disposed around the periphery of the connector head protrusion substantially securing the connector head protrusion in the female receptor.

13. The door closer of claim 1 wherein the door closer housing is mounted to a door surface, the door interposed in a door frame having a track for slideably receiving the linkage arm first end, the linkage arm first end slideably received in the track.

14. The door closer of claim 1, wherein the linkage arm is comprised of a first segment and a second segment, the first and second segments forming a plane and pivotably joined at a midpoint of the linkage arm.

15. A door closer, comprising:

a door closer housing mounted to one of a door frame or a door surface;

a linkage arm for pivoting the door between open and closed positions, the linkage arm having a first and second end, the first end mounted to the other of the door frame or the door surface; and a rotatable connector between the linkage arm and the door closer housing, the linkage arm second end engaging with the rotatable connector, the connector having a rotatable body portion in the door closer housing and a head protrusion substantially secured in a female receptor to transmit rotation about a longitudinal axis of the connector to the linkage arm, the connector head protrusion having a geometrically-shaped cross section and a generally straight profile along the longitudinal axis of the connector and the female receptor having a substantially hourglass-shaped cross-section, the female receptor further having a midpoint with a diameter closely conforming to a diameter of the connector head protrusion profile at a midpoint of the longitudinal axis to enable the connector head protrusion to be slideably secured in the female receptor such that the connector head protrusion and female receptor are rotationally locked about the longitudinal axis of the connector, the female receptor being further movable with respect to the head protrusion to permit limited rotation of the linkage arm on any axis perpendicular to the connector longitudinal axis as the door pivots between open and closed positions.

* * * * *